US009988754B2

(12) United States Patent
Kakaraparthi

(10) Patent No.: US 9,988,754 B2
(45) Date of Patent: Jun. 5, 2018

(54) APPARATUS AND METHOD FOR IDENTIFYING TREATING CHEMISTRY IN A LAUNDRY TREATING APPLIANCE DISPENSING ASSEMBLY

(71) Applicant: WHIRLPOOL CORPORATION, Benton Harbor, MI (US)

(72) Inventor: Venkataprabhath Kakaraparthi, Nellore (IN)

(73) Assignee: Whirlpool Corporation, Benton Harbor, MI (US)

( * ) Notice: Subject to any disclaimer, the term of this patent is extended or adjusted under 35 U.S.C. 154(b) by 65 days.

(21) Appl. No.: 15/079,732

(22) Filed: Mar. 24, 2016

(65) Prior Publication Data

US 2017/0275804 A1 Sep. 28, 2017

(51) Int. Cl.

| | |
|---|---|
| ***D06F 39/02*** | (2006.01) |
| ***D06F 33/02*** | (2006.01) |
| ***D06F 37/04*** | (2006.01) |
| ***D06F 35/00*** | (2006.01) |
| ***C11D 11/00*** | (2006.01) |

(52) U.S. Cl.

CPC ..... *D06F 39/02* (2013.01); *C11D 11/0017* (2013.01); *D06F 33/02* (2013.01); *D06F 35/006* (2013.01); *D06F 37/04* (2013.01)

(58) Field of Classification Search

None

See application file for complete search history.

(56) References Cited

U.S. PATENT DOCUMENTS

| | | | | |
|---|---|---|---|---|
| 8,266,748 | B2 | 9/2012 | Hendrickson et al. | |
| 8,388,695 | B2 | 3/2013 | Hendrickson et al. | |
| 8,397,328 | B2 | 3/2013 | Hendrickson et al. | |
| 8,555,677 | B2 | 10/2013 | Hendrickson et al. | |
| 2013/0042652 | A1* | 2/2013 | Brueckner | D06F 39/02 68/12.02 |
| 2013/0119082 | A1 | 5/2013 | Hendrickson et al. | |
| 2014/0259441 | A1* | 9/2014 | Fulmer | D06F 39/004 8/137 |
| 2014/0259444 | A1 | 9/2014 | Fulmer et al. | |

FOREIGN PATENT DOCUMENTS

| | | | |
|---|---|---|---|
| DE | 102009030287 | A1 | 1/2010 |
| DE | 102009030330 | A1 | 1/2010 |
| DE | 102009030331 | A1 | 1/2010 |

* cited by examiner

*Primary Examiner* — Michael Barr
*Assistant Examiner* — Cristi Tate-Sims

(57) ABSTRACT

A laundry treating appliance comprising a dispensing assembly which can identify laundry treating chemistry filled in a loading cup by way of a material sensor, and supplying said laundry treating chemistry to a proper corresponding bulk reservoir.

12 Claims, 5 Drawing Sheets

APPARATUS AND METHOD FOR IDENTIFYING TREATING CHEMISTRY IN A LAUNDRY TREATING APPLIANCE DISPENSING ASSEMBLY

BACKGROUND

Laundry treating appliances, such as washing machines, refreshers, and non-aqueous systems, can have a configuration based on a rotating container that defines a treating chamber in which laundry items are placed for treating. The laundry treating appliance can have a controller that implements the cycles of operation having one or more operating parameters. The controller can control a motor to rotate the container according to one of the cycles of operation.

Laundry treating appliances can have single dose dispensers, with provided compartments or cups, typically in a drawer or under a cover, in which the user of the appliance would fill with a dose of laundry treating chemistry, such as detergent, that was sufficient for the cycle of operation to be selected. Typically, single dose dispensers have a plurality of cups which are filled by the user with corresponding treating chemistries such as detergent, softener, or bleach. The cups are chemistry-specific in order for the appliance to dispense the correct treating chemistry as needed.

Most treating chemistry cups are labeled so that the user can identify the corresponding treating chemistries for the cups. However, there is the possibility that the user may inadvertently fill a cup with an improper treating chemistry. In the event that the user fills a cup with an improper treating chemistry, laundry may become damaged. Damage to laundry can occur after a single event, or after multiple events. Along with damage to laundry, improperly filling a cup can cause the wash cycle to be ineffective, and laundry may not be as clean as anticipated.

BRIEF SUMMARY

In one aspect, the disclosure relates to a laundry treating appliance which can identify laundry treating chemistry and direct the chemistry to a corresponding bulk reservoir. The user fills a loading cup with laundry treating chemistry, and the treating chemistry is identified by a material property sensor. Once the laundry treating chemistry is identified, a multiplexed valve directs the treating chemistry to the corresponding bulk reservoir.

In another aspect the disclosure relates to a method of operating a laundry treating appliance having a treating chamber for receiving laundry for treatment according to an automatic cycle of operation, the method comprises sensing a material property of a treating chemistry in a loading cup, determining if the treating chemistry is proper/improper for the cup by comparing the sensed material property to a reference material property for the cup, and supplying the treating chemistry to a bulk reservoir for the sensed material property when the treating chemistry is determined improper for the cup.

In another aspect the disclosure relates to a dispenser assembly for a laundry treating appliance for treating laundry according to an automatic cycle of operation including a bulk storage unit having at least two bulk reservoirs for storing different treating chemistries, at least one loading cup, a liquid connector having an inlet coupled to the at least one loading cup and multiple outlets each corresponding to a different one of the at least two bulk reservoirs, with the outlets selectively fluidly coupled to the corresponding one of the at least two bulk reservoirs in response to a control signal, a material property sensory fluidly coupling the at least one loading cup and outputting a material property signal indicative of the sensed material property and a controller receiving as input the material property signal to identify the treating chemistry loaded into the at least one loading cup, and outputting the control signal to control the liquid connector to couple the at least one loading cup to the one of the at least two bulk reservoirs corresponding to the sensed material property.

In yet another aspect the disclosure relates to a laundry treating appliance for treating laundry according to an automatic cycle of operation including a tub defining an interior for retaining liquid, a rotatable container at least partially defining a treating chamber for retaining the laundry for treatment according to the automatic cycle of operating multiple loading cups and bulk reservoirs arranged in pairs for a different treating chemistry, a multiplexed valve having an inlet coupled to the loading cups and multiple outlets each corresponding to a different one of the bulk reservoirs, with the outlets selectively coupled to the corresponding one of the bulk reservoirs in response to a control signal, a material property sensor fluidly coupled to the loading cups and outputting a material property signal indicative of a material property of a treating chemistry in the loading cups, and a controller receiving as input the material property signal to identify the treating chemistry loaded into one of the multiple loading cups, identifying the treating chemistry based on the material property signal, and outputting the control signal to control the multiplexed valve to fluidly couple the one of the multiple loading cups to the bulk reservoir corresponding to the identified treating chemistry.

DETAILED DESCRIPTION

The present disclosure is generally directed towards a laundry treating appliance which can identify laundry treating chemistry and direct the chemistry to a corresponding bulk reservoir. The user fills a loading cup with laundry treating chemistry, and the treating chemistry is identified by a material property sensor. Once the laundry treating chemistry is identified, the treating chemistry is directed to the corresponding bulk reservoir. The directing of the identified treating chemistry to the corresponding bulk reservoir can be done as part of filling the bulk reservoir or to correct when a cup is filled with the incorrect treating chemistry. The directing may be direct or indirect from the cup to the bulk reservoir. The identifying of the treating chemistry may be done inside or outside of the cup. The cups and bulk reservoirs can be arranged in pairs, or a single cup can supply multiple bulk reservoirs, especially when the cup is used to load the bulk reservoirs and not to dispense into the laundry treating appliance.

Figure 1:
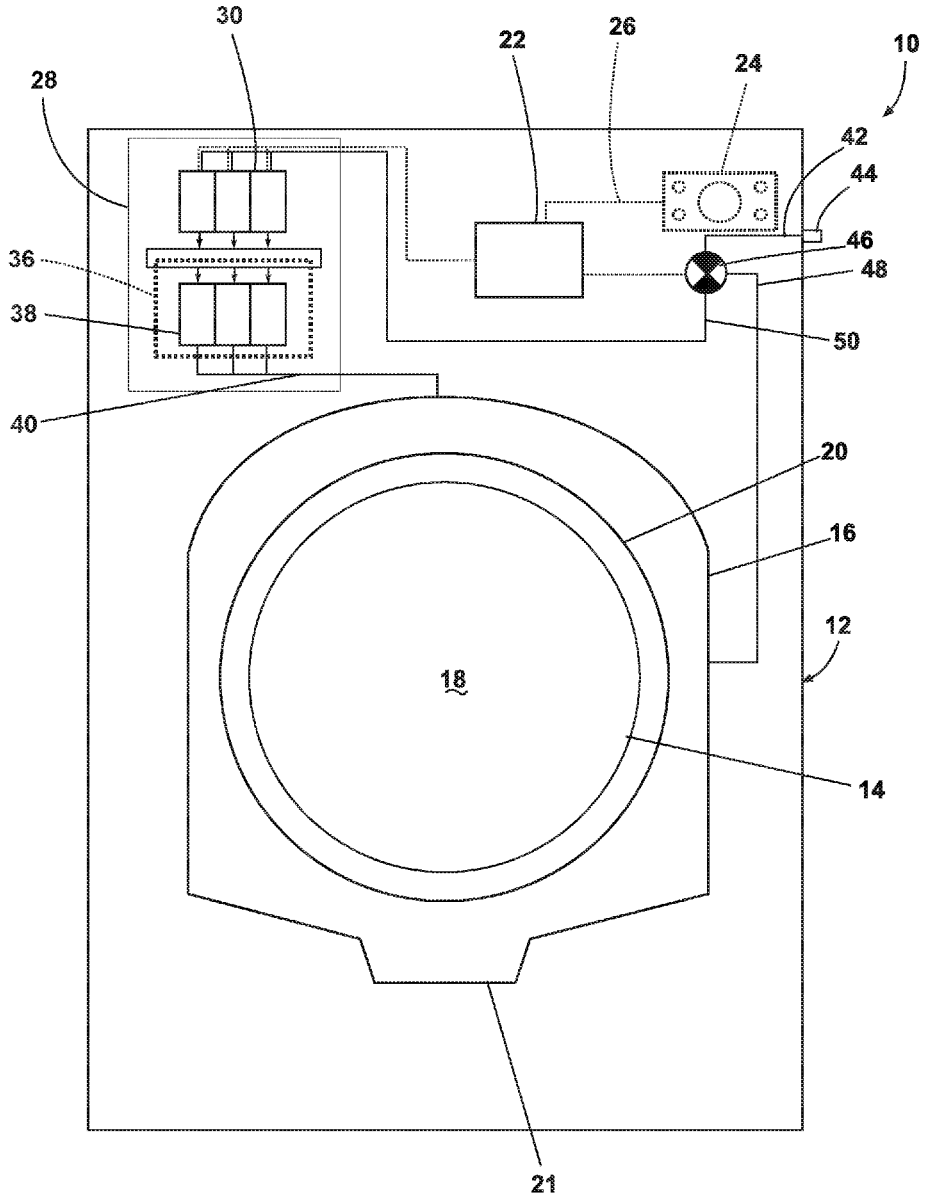
FIG. 1 is a schematic view of a laundry treating appliance in the form of a front-loading, horizontal axis washing machine incorporating a dispensing assembly according to an embodiment of the present disclosure.

Embodiments of the present disclosure can be utilized with a laundry treating appliance, which can be either as a front or top loading and either a horizontal or vertical axis. For purposes of convenience, not limitation, the embodiments of the disclosure are illustrated in the form of a front-loading, horizontal-axis washing machine 10 as illustrated in FIG. 1. A structural support system including a cabinet 12 can define a housing within which a laundry holding system resides. The cabinet 12 can be a housing having a chassis and/or a frame, defining an interior, enclosing components typically found in a conventional washing machine, such as motors, pumps, fluid lines, controls, sensors, transducers, and the like. Such components will not be described further herein except as necessary for a complete understanding of the disclosure.

The washing machine 10 may include a cabinet 12 defining an interior and enclosing components typically found in a conventional washing machine, such as motors, pumps, fluid lines, controls, sensors, transducers, and the like. A door 14 may be mounted to the cabinet 12 to selectively close an access opening to the interior of a tub 16 that defines a treating chamber 18 in which an article may be treated. Examples of articles include, but are not limited to, a hat, a scarf, a glove, a sweater, a blouse, a shirt, a pair of shorts, a dress, a sock, a pair of pants, a shoe, an undergarment, and a jacket. One or more articles form a laundry load. Both the tub 16 and a drum 20 may be located within the interior of the cabinet 12. The tub 16 may be associated with a sump 21 for holding a liquid used during a cleaning cycle. The sump 21 may be normally connected to a drain (not shown) to provide a flow path for removing the liquids.

While the tub 16 may be described as defining the treating chamber 18, with the drum 20 located within the tub 16, and thereby located within the treating chamber 18, it may be that just the drum 20 need be considered the treating chamber 18 as the laundry load may be typically retained within the drum 20 and the treating chemistry may be directed into drum 20.

While not shown, some clothes washers include a recirculation system for recirculation of liquid from the sump to the laundry in the drum 20. The recirculating spray may be used in combination with rotating the drum to draw the sprayed liquid through the laundry using centrifugal force. Alternatively, or in combination with the recirculation system, the liquid may be raised to a level within the tub 16 where a portion of the drum 20 may be submerged. The rotation of the drum 20 causes the laundry to tumble in the liquid. Either of the recirculation or tumble methods of cleaning may be used with any embodiment of the disclosure.

A controller 22 may receive information about a specific cleaning cycle from sensors in the washing machine 10 or via input by a user through a user interface 24. The user interface 24 may have operational controls such as dials, lights, switches, and displays enabling a user to input commands. To aid the input of information by the user, the user interface 24 may be electrically coupled with the controller 22 through user interface leads 26. The user may enter many different types of information, including, without limitation, cycle selection and cycle parameters, such as cycle options. Any suitable cycle may be used. Examples include, Heavy Duty, Normal, Delicates, Rinse and Spin, Sanitize, and Bio-Film Clean Out, to name a few. The term "cleaning cycle" is used to mean one operational cycle of the washing machine 10 that cleans a load of laundry.

The washing machine 10 can also be provided with a dispensing assembly for dispensing treating chemistry to the treating chamber 18 for use in treating the laundry according to a cycle of operation. The dispensing assembly 28 can be a single use dispensing assembly, a bulk dispensing assembly or a combination of a single use and bulk dispensing assembly.

Non-limiting examples of treating chemistries that can be dispensed by the dispensing assembly 28 during a cycle of operation include one or more of the following: water, detergents, softeners, bleach, rinse aids, surfactants, enzymes, fragrances, stiffness/sizing agents, wrinkle releasers/reducers, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

It has been noted that each treating chemistry has unique material properties, therefore, material properties may be used as an identifier for a specific treating chemistry. A database or table of information can be created showing material properties for specific treating chemistries. This database may be used by the controller as a reference to look up the specific treating chemistry based on a sensed material property and determine the identification of the treating chemistry. Non-limiting examples of material property sensors which can output a material property signal indicative of a material property of a treating chemistry can include a pH sensor, viscosity sensor, specific gravity sensor, density sensor, conductivity sensor, or refractive index sensor although any other sensors sensing a material property may be used without departing from the scope of this disclosure.

The dispensing assembly 28 can have multiple treating chemistry loading cups 30 fluidly coupled to the treating chamber 18. FIG. 1 illustrates the multiple loading cups 30 as being located in the upper portion of the cabinet 12 such that a user may access it from the exterior of the cabinet 12. The dispensing assembly 28 may also include bulk reservoirs 38 located within a bulk storage unit 36, arranged to pair with corresponding loading cups 30.

Although the loading cups and bulk reservoirs have been illustrated or described as rectangular box-like containers, the loading cups and bulk reservoirs may be any type of container configured to store treating chemistry. The containers can be fixed or removable or a combination of both. The containers can be mounted in a drawer that is moved in/out of the cabinet 12. The containers can be mounted, fixed or moveable, within the cabinet and freely accessible from the exterior or located behind a cover. The containers may have any shape and size that is receivable within the dispenser. The containers may be flexible, rigid, expandable, or collapsible. The containers may be made of any type of material. Some examples of suitable containers are, without limitation, a plastic container, a cardboard container, a coated cardboard container, and a bladder, all of which are capable of being received within the dispenser.

A water supply provides water to the dispensing assembly 28. The water supply is illustrated as having a conduit 42 fluidly coupled with a water supply 44, and a valve 46. The water supply 44 may be fluidly coupled directly to the treating chamber 18 through conduit 42 to valve 46 and then through water dispensing line 48. The water supply 44 may also be coupled to the treating chamber 18 via the dispensing assembly 28, where water is supplied to the dispensing assembly 28 through the conduit 42, the valve 46, a water supply conduit 50, and a water diverter, which controls the flow of water to either at least one of the loading cups 30 or at least one bulk reservoir 38. A dispensing line 40 supplies treating chemistry to the drum 20.

Figure 2:
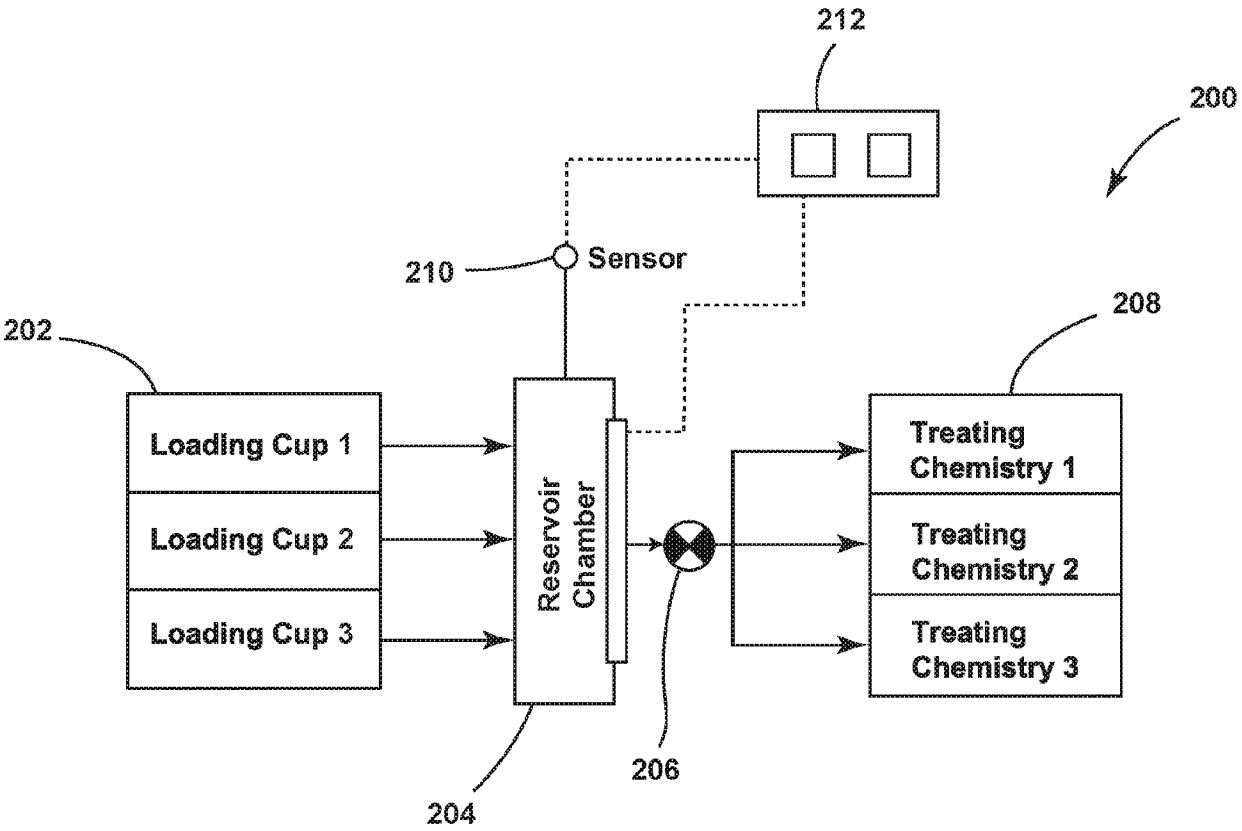
FIG. 2 is a schematic view of an exemplary dispensing assembly according to an embodiment of the present disclosure that may be used in the washing machine illustrated in FIG. 1.

As illustrated in FIG. 2, a dispensing assembly 200 can include material property sensors 210 used to determine a material property of treating chemistry such as pH value or viscosity. According to one embodiment of the disclosure, a material property sensor 210 is fluidly coupled to a reservoir chamber 204 and a controller 212. Loading cups 202 are fluidly coupled to the reservoir chamber 204 which is fluidly coupled to a liquid connector such as a multiplexed valve 206. The multiplexed valve 206 selectively couples bulk reservoirs 208 in response to a control signal from controller 212. The liquid connector may also exist in the form of a pump or other type of valve, or in combination with multiple liquid connectors. When a user fills at least one of the multiple loading cups 202 with a treating chemistry, the treating chemistry can flow to the reservoir chamber 204 where a sensor 210 determines a material property of the treating chemistry. Alternately, the sensor 210 may be coupled to loading cups 202, and a material property of a treating chemistry can be determined prior to the treating chemistry flowing to the reservoir chamber 204. The sensor 210 may couple with a single or multiple loading cups 202. The reservoir chamber may comprise a single chamber or multiple chambers to accommodate a single treating chemistry or multiple treating chemistries. The controller 212 determines from the detected material property whether or not the treating chemistry is proper or improper for the one of the multiple loading cups 202 in which the treating chemistry was filled. The controller 212 then sends signal to the multiplexed valve 206 to allow the treating chemistry to flow to the corresponding bulk reservoir 208 for the treating chemistry. The bulk reservoir may comprise a single reservoir or multiple reservoirs to accommodate a single treating chemistry or multiple treating chemistries. Treating chemistry can be directed to a corresponding bulk reservoir 208 by the multiplexed valve 206 when it is determined proper for the one of the multiple loading cups 202. Treating chemistry can also be directed to a corresponding bulk reservoir 208 when it is determined improper for one of the multiple loading cups 202.

Figure 3:
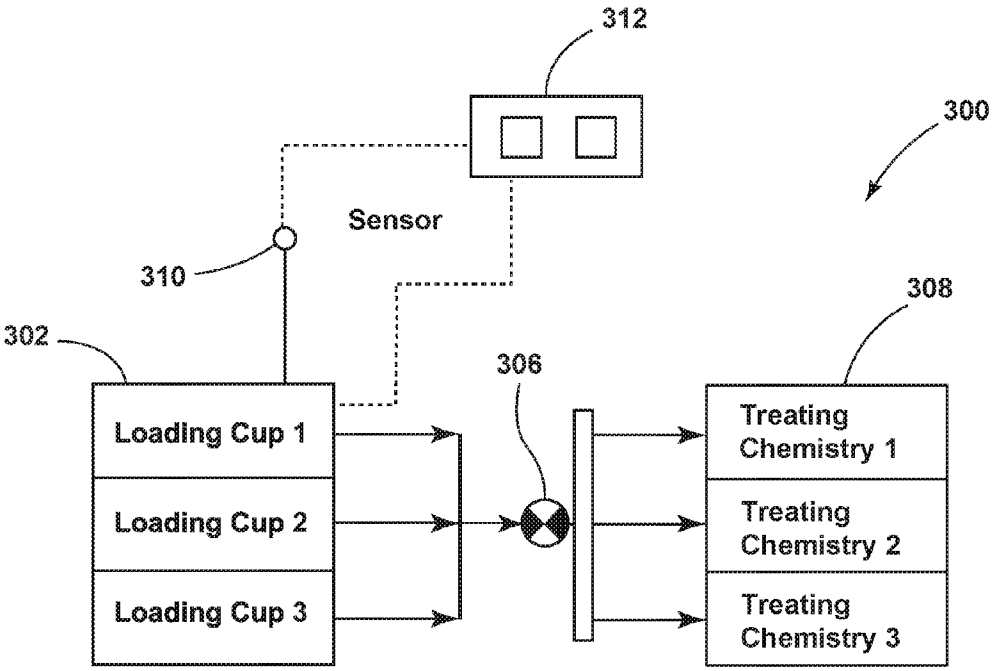
FIG. 3 is a schematic view of a second exemplary dispensing assembly according to an embodiment of the present disclosure that may be used in the washing machine illustrated in FIG. 1.

In another embodiment of the disclosure as illustrated in FIG. 3, a material property sensor 310 is coupled to loading cups 302 and a controller 312 in dispensing assembly 300. In this embodiment, a reservoir chamber is excluded from the dispensing assembly 300. Loading cups 302 fluidly couple to a liquid connector, shown here as a multiplexed valve 306. The multiplexed valve 306 selectively couples bulk reservoirs 308 in response to a control signal from controller 312. The operations of dispensing assembly 300 are generally the same as the operations of dispensing assembly 200. However, in dispensing assembly 300, the multiplexed valve 306 is directly coupled to loading cups 302 rather than a reservoir chamber 204. Consequently, when a user fills at least one of the multiple loading cups 302 with a treating chemistry, the controller 312 determines a detected material property by sensor 310 and sends signal to the multiplexed valve 306, the treating chemistry can be immediately directed to a corresponding bulk reservoir 308.

Figure 4:
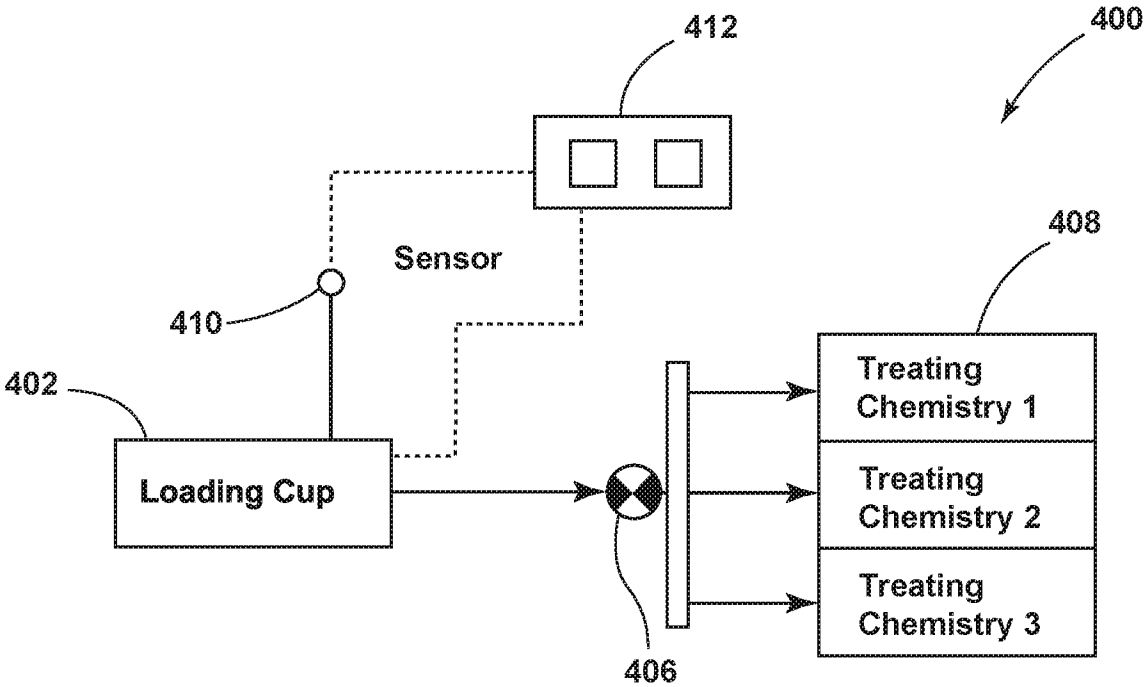
FIG. 4 is a schematic view of a third exemplary dispensing assembly according to an embodiment of the present disclosure that may be used in the washing machine illustrated in FIG. 1.

In yet another embodiment of the disclosure as illustrated in FIG. 4, a single loading cup 402 can be used in place of multiple loading cups. In this embodiment, a material property sensor 410 is coupled to one loading cup 402 and a controller 412 in dispensing assembly 400. The loading cup 402 fluidly couples to a liquid connector, shown here as a multiplexed valve 406. The multiplexed valve 406 selectively couples bulk reservoirs 408 in response to a control signal from controller 412. While the material property sensor 410 is shown operably coupled to the cup 402, it could also be coupled to the multiplexed valve 406 or any other liquid connector, including any structure fluidly coupling the cup 402 to the multiplexed valve 406.

The operations of dispensing assembly 400 are generally the same as the operations of dispensing assembly 300. However, in dispensing assembly 400, there exists only one loading cup. This enables the user to fill the loading cup 402 with treating chemistry, and the treating chemistry will be directed to a corresponding bulk reservoir 408 by the controller 412 based on the signal from the material property sensor 410. As a single cup 402 is being used, to prevent contamination from prior chemistry placed in the cup 402, the loading cup 402 can be flushed with water or any other suitable rinse-aid in order to remove residue from previous treating chemistries from the loading cup 402. The flushing can be automatic, the flushing occurring in between automatic cycles of operation, or the flushing can be manually controlled by a user. For example, a user may push a button to initiate flushing of the loading cup 402.

The foregoing descriptions include exemplary sensor locations. Other locations may be utilized, for example, incorporated into valve structures, the dispensing line 40, or incorporated into an auxiliary receptacle which may be part of the dispensing assembly. Also, any of the embodiments can include a flushing mechanism in order to remove residue from treating chemistries, in any location such as in loading cups, a reservoir chamber, or in bulk reservoirs.

Figure 5:
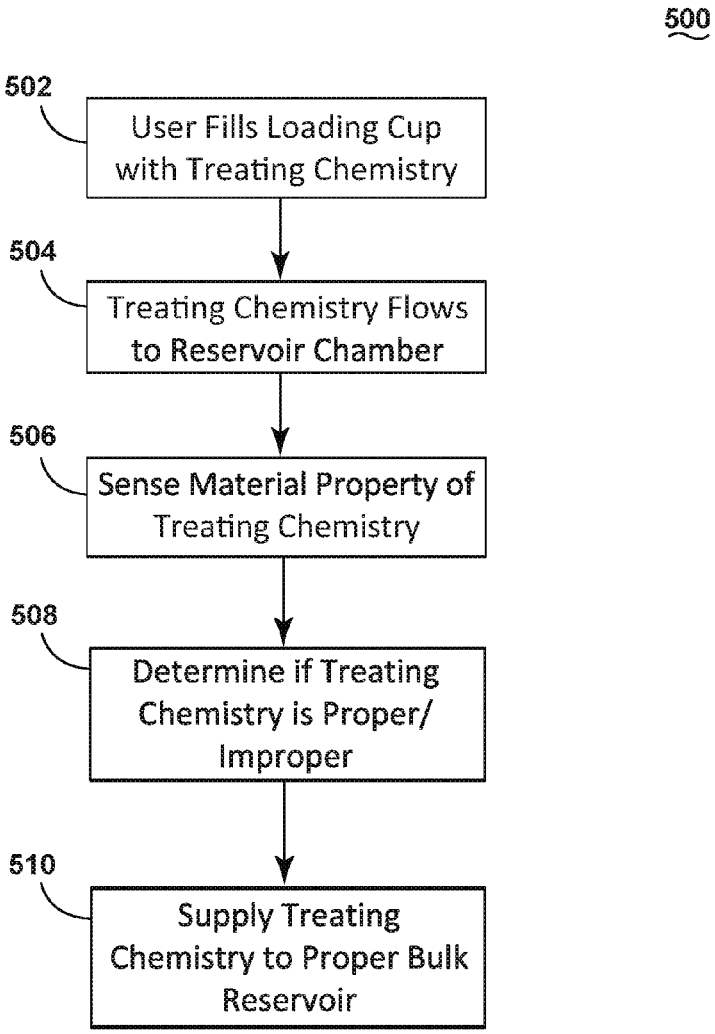
FIG. 5 is a flow chart for operating the washing machine according to an embodiment of the present disclosure.

For any of the embodiments, it will be apparent to one skilled in the art upon an examination of FIG. 5 that treating chemistry can be properly stored in the washing machine 10 by including the steps of the flow chart of FIG. 5 into a typical cycle of the washing machine 10. While the method of FIG. 5 is described with respect to the embodiment of FIG. 2, the method can be used with all the embodiments. While the steps of the method illustrated in FIG. 5 are discussed in schematic form, the implementation of these steps into a cycle of operation for the washing machine 10 would be apparent to one skilled in the art of washing machine cycle design and programming. Turning to FIG. 5, an example flow chart is shown for operating the washing machine 10 according to an embodiment of the disclosure in a manner to address the problem of filling a loading cup with improper treating chemistry, thereby decreasing the likelihood of damaging laundry or executing ineffective wash cycles.

The method 500 according to one embodiment of the disclosure begins at step 502 where a user fills a loading cup with treating chemistry. At step 504 the treating chemistry flows to a reservoir chamber 204 where a material property of the treating chemistry is sensed 506. The controller coupled to the sensor 210 determines if the treating chemistry is proper or improper at step 508 by receiving as input the material property signal and identifying the treating chemistry by comparing the sensed material property to a reference material property for the cup. At step 510 the treating chemistry is supplied to the proper bulk reservoir 208 when the controller outputs a control signal to control the multiplexed valve 206 to fluidly couple the one of the multiple loading cups 202 to the bulk reservoir 208 corresponding to the identified treating chemistry. When called for by a cycle of operation for the laundry treating appliance, treating chemistry can be dispensed from the either the loading cups 202 or the bulk reservoir 208. The laundry treating appliance can dispense treating chemistry from loading cups 202 when treating chemistry is determined proper for the loading cup and utilize the bulk reservoir 208 as storage for improperly loaded treating chemistry so as to prevent the improper treating chemistry from being dispensed during a cycle of operation. The laundry treating appliance can also dispense treating chemistry from the bulk reservoir 208, wherein the loading cups 202 can be utilized to fill or replenish the bulk reservoir 208. If the treating chemistry is determined to be improper and is supplied to the corresponding bulk reservoir 208, then the dispensing assembly can dispense the proper treating chemistry from the corresponding bulk reservoir 208 during the execution of the cycle of operation.

The sequence of steps depicted in FIG. 5 are for illustrative purposes only, and are not meant to limit the method in any way as it is understood that the steps may process in a different logical order, additional or intervening steps may be included, described steps may be divided into multiple steps, or steps may be eliminated, without detraction from the embodiment of the disclosure. For example, step 504 where a treating chemistry flows to a reservoir chamber, may be eliminated.

Additionally, it should be appreciated that the aforementioned methods within a horizontal or vertical axis washing machine are exemplary, and use within alternative appliances are contemplated. The methods can alternatively be utilized in additional laundry treating appliances such as a combination washing machine and dryer, a tumbling refreshing/revitalizing machine, an extractor, and a non-aqueous washing apparatus, in non-limiting examples.

The above-described embodiments are more accurate and precise as compared to the existing solutions, as the determinations are driven directly by the optimal conditions for operation of the washing machine 10. Furthermore, the above-described embodiments offer solutions that continuously provide information about the operation of the washing machine 10, rather than relying on an extrapolation, which fails to capture the true behavior of the washing machine.

To the extent not already described, the different features and structures of the various embodiments can be used in combination with each other as desired. That one feature is not illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to disclose the invention, including the best mode, and to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A laundry treating appliance for treating laundry according to an automatic cycle of operation comprising:

a tub defining an interior for retaining liquid;

a rotatable container at least partially defining a treating chamber for retaining the laundry for treatment according to the automatic cycle of operating;

multiple loading cups and bulk reservoirs arranged in pairs for a different treating chemistry;

a multiplexed valve having an inlet coupled to the loading cups and multiple outlets each corresponding to a different one of the bulk reservoirs, with the outlets selectively coupled to the corresponding one of the bulk reservoirs in response to a control signal;

a material property sensor fluidly coupled to the loading cups and outputting a material property signal indicative of a material property of a treating chemistry in the loading cups; and a controller receiving as input the material property signal to identify the treating chemistry loaded into one of the multiple loading cups, identifying the treating chemistry based on the material property signal, and outputting the control signal to control the multiplexed valve to fluidly couple the one of the multiple loading cups to the bulk reservoir corresponding to the identified treating chemistry.

2. The laundry treating appliance of claim 1 wherein the controller provides the control signal when the identifying the treating chemistry indicates an improper treating chemistry in the one of the multiple loading cups.

3. The laundry treating appliance of claim 2, further comprising a pump fluidly coupling the multiplexed valve to the bulk reservoirs and pumping the treating chemistry from the one of the multiple loading cups, through the multiplexed valve, and to the corresponding bulk reservoir.

4. The laundry treating appliance of claim 3, further comprising a material property sensor for each of the multiple loading cups.

5. The laundry treating appliance of claim 4 wherein the material property sensor comprises at least one of a pH sensor or a viscosity sensor.

6. The laundry treating appliance of claim 1, further comprising a material property sensor for each of the multiple loading cups.

7. The laundry treating appliance of claim 1 wherein the material property sensor comprises at least one of a pH sensor or a viscosity sensor.

8. A dispenser assembly for a laundry treating appliance for treating laundry according to an automatic cycle of operation comprising:

a bulk storage unit having at least two bulk reservoirs for storing different treating chemistries;

at least one loading cup;

a liquid connector having an inlet coupled to the at least one loading cup and multiple outlets each corresponding to a different one of the at least two bulk reservoirs, with the outlets selectively fluidly coupled to the corresponding one of the at least two bulk reservoirs in response to a control signal;

a material property sensor fluidly coupled to the at least one loading cup and outputting a material property signal indicative of the sensed material property; and a controller receiving as input the material property signal to identify the treating chemistry loaded into the at least one loading cup, and outputting the control signal to control the liquid connector to couple the at least one loading cup to the one of the at least two bulk reservoirs corresponding to the sensed material property.

9. The dispenser assembly of claim 8 wherein the controller provides the control signal when the identifying the treating chemistry indicates an improper treating chemistry in the at least one loading cup.

10. The dispenser assembly of claim 8, further comprising a pump fluidly coupling the liquid connector to the bulk reservoirs and pumping the treating chemistry from the at least one loading cup, through the liquid connector, and to the corresponding bulk reservoir.

11. The dispenser assembly of claim 10 wherein the material property sensor comprises at least one of a pH sensor or a viscosity sensor.

12. The dispenser assembly of claim 11, further comprising a corresponding loading cup for each bulk reservoir and a material property sensor for each of the corresponding loading cups.

* * * * *